US011932985B2

(12) United States Patent
Zunker et al.

(10) Patent No.: US 11,932,985 B2
(45) Date of Patent: Mar. 19, 2024

(54) HEAT EXCHANGER DEVICE AND FLOOR MODULE FOR A LAUNDRY TREATMENT MACHINE

(71) Applicant: Miele & Cie. KG, Gütersloh (DE)

(72) Inventors: Ingrid Zunker, Gütersloh (DE); Jürgen Rösch, Rheda-Wiedenbrück (DE); Thomas Vartmann, Beelen (DE); Christof Kruschinski, Gütersloh (DE)

(73) Assignee: MIELE & CIE. KG, Gütersloh (DE)

( * ) Notice: Subject to any disclaimer, the term of this patent is extended or adjusted under 35 U.S.C. 154(b) by 72 days.

(21) Appl. No.: 17/493,891

(22) Filed: Oct. 5, 2021

(65) Prior Publication Data

US 2022/0106729 A1 Apr. 7, 2022

(30) Foreign Application Priority Data

Oct. 6, 2020 (DE) ..... 10 2020 126 056.3

(51) Int. Cl.
*D06F 58/00* (2020.01)
*D06F 58/26* (2006.01)
(Continued)

(52) U.S. Cl.
CPC ..... *D06F 58/26* (2013.01); *F28F 13/06* (2013.01); *F28F 1/24* (2013.01); *F28F 2250/102* (2013.01); *F28F 2280/06* (2013.01)

(58) Field of Classification Search
CPC ..... D06F 58/206; F24F 13/30; F28D 1/0477; F28D 1/0435
See application file for complete search history.

(56) References Cited

U.S. PATENT DOCUMENTS 6,253,839 B1 * 7/2001 Reagen ..... B23P 15/26 165/182
2010/0107703 A1 * 5/2010 Hisano ..... D06F 58/206 68/20

(Continued)

FOREIGN PATENT DOCUMENTS

CN 102206916 A 10/2011
CN 104233735 A 12/2014

(Continued)

OTHER PUBLICATIONS

European Search Report and Written Opinion dated Mar. 1, 2022.

*Primary Examiner* — Eric S Ruppert
(74) *Attorney, Agent, or Firm* — Dickinson Wright PLLC

(57) ABSTRACT

A heat-exchange device (2) for a laundry treatment machine includes a first heat exchanger (4) and a second heat exchanger (6) that are disposed successively along a flow path (10) of process air in an operating state of the heat-exchange device (2), and are connected to each other by a connecting plate (8). The first heat exchanger (4) includes a first side plate (12), and the second heat exchanger (6) includes a second side plate (14), wherein the first and the second side plates (12, 14) are each disposed on a side of the heat-exchange device (2) opposite the connecting plate (8) and are disconnected at least in a pre-installation state of the heat-exchange device (2). A base module is configured to fix the relative position of the first and second heat exchangers (4, 6) with respect to each other.

14 Claims, 4 Drawing Sheets

(51) Int. Cl.
*F28F 13/06* (2006.01)
*F28F 1/24* (2006.01)

(56) References Cited

U.S. PATENT DOCUMENTS

| | | | | |
|---|---|---|---|---|
| 2016/0168777 | A1 | 6/2016 | Bison et al. | |
| 2016/0318090 | A1* | 11/2016 | Hashimoto | F28F 1/32 |
| 2016/0376744 | A1 | 12/2016 | Lv et al. | |

FOREIGN PATENT DOCUMENTS

| | | | |
|---|---|---|---|
| CN | 205617125 | U | 10/2016 |
| DE | 10217125054 | B4 | 10/2019 |
| EP | 2674527 | A1 | 12/2013 |
| EP | 2881514 | B1 | 8/2019 |
| WO | 2013186129 | A1 | 12/2013 |
| WO | 2017174766 | A1 | 10/2017 |
| WO | 2021058365 | A1 | 4/2021 |

* cited by examiner

HEAT EXCHANGER DEVICE AND FLOOR MODULE FOR A LAUNDRY TREATMENT MACHINE

TECHNICAL FIELD

The invention relates to a heat-exchange device for a laundry treatment machine and to a base module for a laundry treatment machine.

BACKGROUND

Such heat-exchange devices and base modules for laundry treatment machines are already known from the prior art in a variety of embodiments. The known heat-exchange devices herein comprise a first heat exchanger and a second heat exchanger, wherein the two heat exchangers are disposed successively along a flow path of process air in an operating state of the heat-exchange device and are connected to each other by a connecting plate. These heat-exchange devices are accommodated in their operating state, in a manner known to the person skilled in the art, in at least one housing part of the known base modules.

SUMMARY

It is an objective of the invention to improve a heat-exchange device for a laundry treatment machine and a base module for a laundry treatment machine.

According to the invention, this objective is met by a heat-exchange device for a laundry treatment machine, in which the first heat exchanger includes a first side plate and the second heat exchanger includes a second side plate, wherein the first and the second side plates are each disposed on a side of the heat-exchange device opposite the connecting plate, and wherein the first and the second side plates are disconnected at least in a pre-installation state of the heat-exchange device. Furthermore, this objective is met by a base module for a laundry treatment machine having the features of patent claim 9. The laundry treatment machine can be configured as a household device or a commercial device, i.e., a device for professional use. The laundry treatment machine can be, for example, a laundry dryer or a washer-dryer, i.e., a combination device comprising of a washing machine and a laundry dryer. The insert component of the base module can be configured, for example, as a sealed unit, in order to effectively avoid, or at least reduce, an undesired bypass flow of the process air in edge regions of the two heat exchangers of the inventive heat-exchange device. Advantageous designs and refinements of the invention are indicated in the subsequent dependent claims.

The advantage achievable using the invention consists in particular in that a heat-exchange device for a laundry treatment machine and a base module for a laundry treatment machine are improved. Due to the inventive design of the heat-exchange device, the warehousing and logistics as well as the manufacturing of the heat-exchange device, and thus of the laundry treatment machine equipped therewith, is significantly simplified, without having to omit an angled flow path of the process air through the heat-exchange device, namely through the two heat exchangers of the heat-exchange device. This angled flow path of the process air flowing through the heat-exchange device in its operating state is expedient and usual in laundry treatment machines for reasons of installation space and with regard to flow technology. However, in comparison to a heat-exchange device without angled flow path, this embodiment of the heat-exchange device usually has the disadvantage that such heat-exchange devices have greater space requirements during their storing and transport. Furthermore, this type of heat-exchange device is more complex to manufacture and thus more expensive. The invention provides a remedy here.

In principle, the inventive heat-exchange device can be broadly selected for a laundry treatment machine within broad, suitable limits according to the type, functionality, material, dimensioning, and arrangement.

One advantageous refinement of the inventive heat-exchange device for a laundry treatment machine provides that the connecting plate is configured such that the connecting plate stabilizes the heat-exchange device at least in its pre-installation state such that the heat-exchange device can be handled as an essentially rigid construction unit. In this way the handling of the heat-exchange device is significantly simplified up to its operating state during storage, transport, and manufacture of the laundry treatment machine equipped therewith.

A further advantageous refinement of the inventive heat-exchange device for a laundry treatment machine provides that in the pre-installation state of the heat-exchange device, the two heat exchangers are disposed with respect to each other such that a first section of the flow path through the first heat exchanger and a second section of the flow path through the second heat exchanger are disposed essentially in a straight extension with respect to each other. The handling of the heat-exchange device is thereby further improved up to its operating state during storage, transport, and manufacture of the laundry treatment machine equipped therewith. For example, the transport of the preinstalled heat-exchange device, for the purpose of manufacturing the laundry treatment machine equipped therewith, from a supplier to the laundry treatment machine, is thereby realizable in a significantly more space-saving and thus more cost-effective manner.

One advantageous refinement of the above-mentioned embodiment of the inventive heat-exchange device for a laundry treatment machine provides that in the operating state of the heat-exchange device, the first heat exchanger and the second heat exchanger are disposed with respect to each other such that the first section of the flow path and the second section of the flow path enclose an angle not equal to 0° and not equal to 180°, preferably an acute angle. In this way a particularly advantageous arrangement is made possible in terms of flow technology of the heat-exchange device, including the two heat exchangers, with respect to a remainder of the laundry treatment machine, for example, a blower of the laundry treatment machine for pumping the process air in a blower coupled to a drum drive for a laundry drum of the laundry treatment machine. This applies in particular to the preferred embodiment of this refinement.

Another advantageous refinement of the inventive heat-exchange device for a laundry treatment machine provides that in the operating state of the heat-exchange device the first side plate and the second side plate are connectable to each other in a friction-fit manner using a side-plate connector, wherein the two side plates and the side-plate connector include mutually corresponding connecting means. The heat-exchange device including the two heat exchangers in their operating state is thereby additionally stabilized in a simple manner in terms of construction and manufacture. This is advantageous in particular if the two heat exchangers are disposed angled with respect to each other, so that the above-mentioned angled flow path is made possible by the heat-exchange device. For example, the mutually corresponding connecting means of the two side plates on the one side and of the side-plate connector on the other side can be configured as mutually corresponding latch means or the like. Here the side plate connector can be configured differently in terms of material than the two side plates, for example, as a plastic part. Here the side-plate connector can also have an additional function, for example, as a flow conductor for the process air flow through the inventive heat-exchange device. In principle, however, it is also conceivable that in other embodiments of the inventive heat-exchange device the two side plates remain disconnected in their operating state.

A particularly advantageous refinement of the inventive heat-exchange device for a laundry treatment machine provides that the connecting plate includes at least one material weakening, wherein the respective material weakening is disposed in the connecting plate extending essentially transverse to the flow path. In this way a transition of the inventive heat-exchange device from its pre-installation state into its operating state is significantly simplified, since, for example, a bending of the connecting plate, for the purpose of producing an angled arrangement of the two heat exchangers with respect to each other, is made possible with much less effort. Thus embodiments of the inventive heat-exchange device are conceivable, wherein the above-mentioned transition of the heat-exchange device into its operating state is performable merely with muscle power. In addition, the respective material weakening ensures that the bending of the connecting plate of the inventive heat-exchange device is effected at a previously defined location of the connecting plate. With a plurality of material weaknesses it is also possible to give a more complex shape to the bending of the connecting plate. Here the at least one material weakening can be configured in any manner known to the person skilled in the art, for example, as a material thinning or as a free punch.

One advantageous refinement of the above-mentioned embodiment of the inventive heat-exchange device for a laundry treatment machine provides that the respective material weakening extends essentially from one free end to a free end of the connecting plate opposite this free end. On the one hand, in this way the material weakening itself is realizable in a simple manner in terms of manufacturing technology. On the other hand, with the respective material weakening a defined bending line is thereby made possible.

A further advantageous refinement of the inventive heat-exchange device for a laundry treatment machine provides that the first and/or the second heat exchanger is/are configured as a fin heat exchanger, comprising a plurality of fins disposed in parallel and spaced with respect to each other, for heat transmission between the respective heat exchanger and the process air, and at least one heat-exchange tube connected to the fins in a heat-conducting manner for guiding a heat-transmission fluid, preferably that the heat-exchange device includes a soldering side for automatic soldering of the at least one heat-exchange tube, particularly preferably that the soldering side is disposed on the connecting-plate side of the heat-exchange device. In this way the respective heat exchanger of the inventive heat-exchange device is configured as particularly suitable for a laundry treatment machine. In addition, the manufacturing of the respective heat-exchanger of the inventive heat-exchange device is further simplified in the preferred and in particular in the particularly preferred embodiment of this refinement. Despite the provision of a defined soldering side for manufacturing the respective heat exchanger, for example, for the purpose of an automatic soldering, embodiments of the inventive heat-exchange device according to this refinement are also conceivable, wherein, for example, the side of the inventive heat-exchange device opposite the soldering side is also soldered.

In principle, the inventive base module is freely selectable for a laundry treatment machine within broad, suitable limits according to the type, functionality, material, and dimensioning.

One advantageous refinement of the inventive base module for a laundry treatment machine provides that the relative position of the first heat exchanger and of the second heat exchanger with respect to each other in the operating state of the heat-exchange device is fixable in this operating state using the housing part. The relative position of the two heat exchangers with respect to each other is thereby fixable in a particularly simple manner in terms of construction and manufacture. For example, in the operating state of the heat exchanger device, the described fixing of the two heat exchangers can consist in that the two heat exchangers with the connecting plate on the one side and the corresponding side plate on the other side, engage in an interlocking manner into corresponding grooves of the housing part of the base module, i.e. of the base part, of the cover part or of the insert part.

An exemplary embodiment of the invention is depicted purely schematically in the drawings and is described in greater detail below.

DETAILED DESCRIPTION OF THE DRAWINGS

In FIGS. 1 to 4*b*, an exemplary embodiment of the inventive heat-exchange device for a laundry treatment machine is depicted in a purely exemplary manner.

Figure 1:
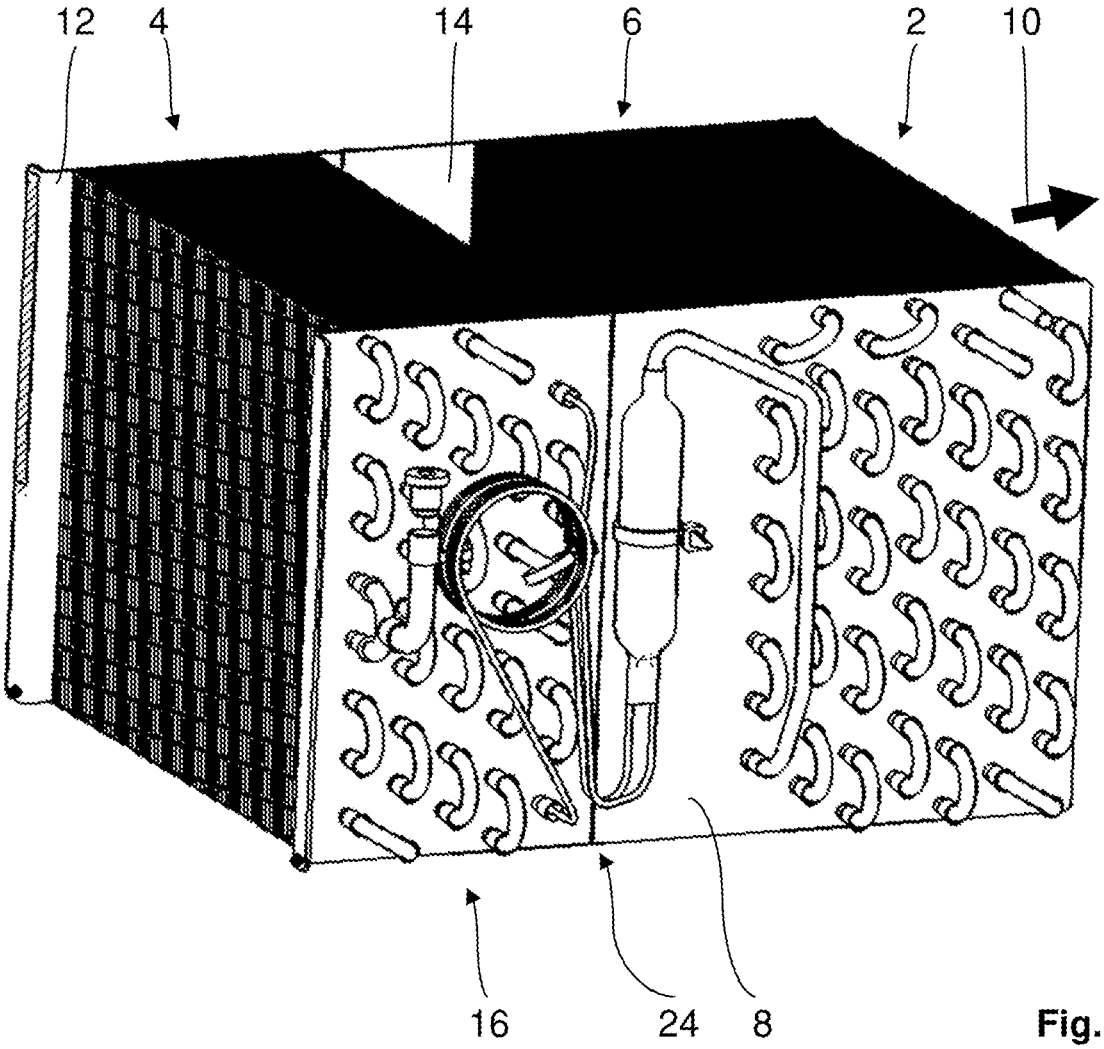
FIG. 1 shows an exemplary embodiment of the inventive heat-exchange device for a laundry treatment machine in a perspective view, including the heat-exchange device in its pre-installation state.

The laundry treatment machine (not depicted) is configured as a household laundry dryer. The heat-exchange device 2 for this laundry treatment machine comprises a first heat exchanger 4 and a second heat exchanger 6, wherein the two heat exchangers 4, 6 are disposed successively along a flow path of process air (not-depicted) in an operating state of the heat-exchange device 2 depicted in FIGS. 4*a* and 4*b* and are connected to each other by a connecting plate 8. In FIGS. 1 and 3 to 4*b* the flow path of the process air is respectively symbolized by an arrow 10, wherein the flow path 10 depicted in FIG. 1 is merely a theoretical flow path of the process air, since the process air flows through the heat-exchange device 2 virtually only in its operating state depicted in FIGS. 4*a* and 4*b*. In FIG. 4*a* the heat-exchange device 2 is depicted in a plan view, and in FIG. 4*b* the heat-exchange device 2 is depicted in a partial perspective view.

Furthermore, the first heat exchanger 4 includes a first side plate 12, and the second heat exchanger 6 includes a second side plate 14, wherein the first and the second side plates 12, 14 are each disposed on a side of the heat-exchange device 2 opposite the connecting plate 8, and wherein the first and the second side plates 12, 14 are disconnected in a pre-installation state of the heat-exchange device 2 as depicted in FIG. 1.

In the present exemplary embodiment, the first and the second heat exchangers 4, 6 are each configured as a fin heat exchanger. Here each heat exchanger 4, 6 comprises a plurality of fins disposed in parallel and spaced from one another for heat transmission between the respective heat exchanger 4, 6 and the process air, and at least one heat-exchange tube connected to the fins in a heat-conducting manner for guiding a heat-exchange fluid, wherein the heat-exchange device 2 includes a soldering side 16 for automatic soldering of the at least one heat-exchange tube, namely such that the soldering side 16 is disposed on the connecting-plate-side of the heat-exchange device 2. The first heat exchanger 4 is configured as an evaporator, and the second heat exchanger 6 is configured as a condenser of a coolant circuit (not depicted in detail) of a heat pump of the laundry treatment machine.

The connecting plate 8 is configured such that the connecting plate 8 stabilizes the heat-exchange device 2 at least in its pre-installation state such that the heat-exchange device 2 can be handled as an essentially rigid construction unit.

In the pre-installation state depicted in FIG. 1 of the heat-exchange device 2, the two heat exchangers 4, 6 are disposed with respect to each other such that a first section of the flow path 10 through the first heat exchanger 4, and a second section of the flow path 10 through the second heat exchanger 6, are disposed essentially in straight extension with respect to each other. As already explained above, the flow path 10 according to FIG. 1 is merely a theoretical flow path of the process air for explaining the relative position of the two heat exchangers 4, 6 with respect to each other in the pre-installation state of the heat-exchange device 2.

Figure 4A:
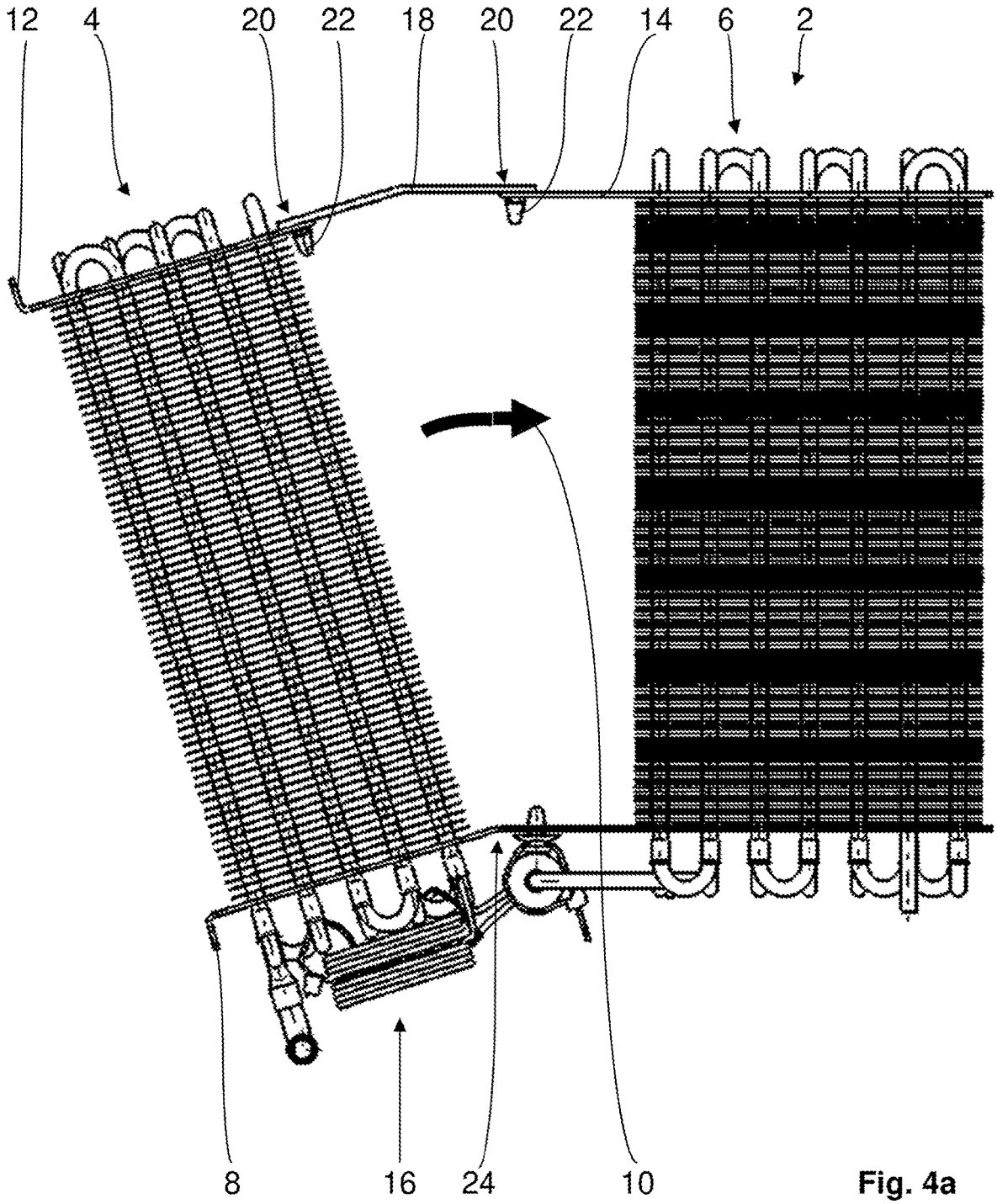
FIGS. 4*a* and 4*b* show the exemplary embodiment including the heat-exchange device in its operating state.
Figure 4B:
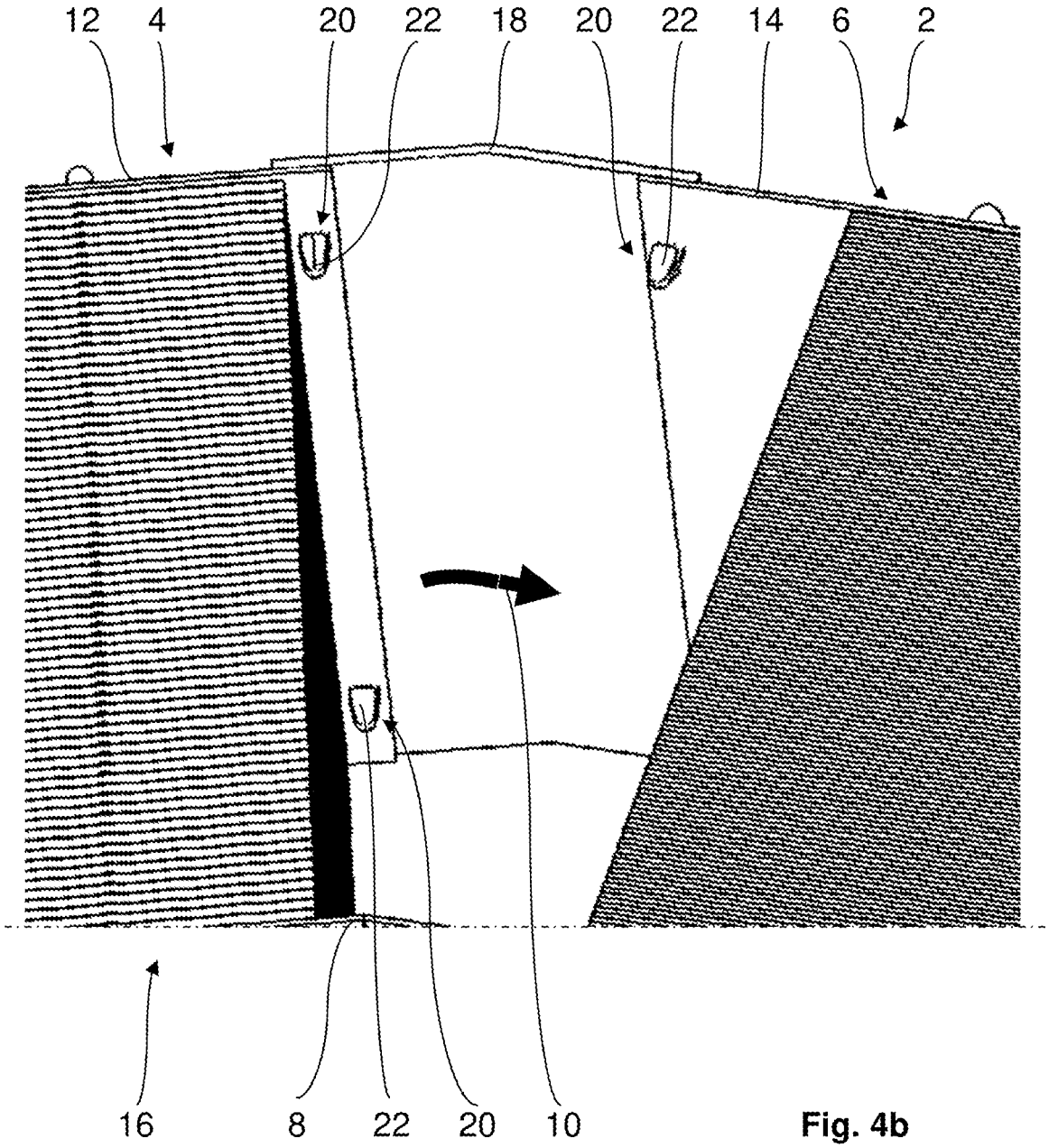

As can clearly be seen from FIGS. 4*a* and 4*b*, in the operating state of the heat-exchange device 2, the first heat exchanger 4 and the second heat exchanger 6 are disposed with respect to each other such that the first section of the flow path 10 and the second section of the flow path 10 enclose an angle not equal to 0° and not equal to 180°, namely an acute angle.

Furthermore, it can be seen from FIGS. 4*a* and 4*b* that in the operating state of the heat-exchange device 2, the first side plate 12 and the second side plate 14 are connectable to each other in a friction-fit manner using a side plate connector 18 made of plastic, wherein the two side plates 12, 14 and the side-plate connector 18 include mutually corresponding connecting means 20, 22. In the present exemplary embodiment the mutually corresponding connecting means 20, 22 are configured as mutually corresponding latching means, namely as latch openings 20 formed in the two side plates 12, 14, and as latch hooks 22 formed on the side plate connector 18.

Figure 2:
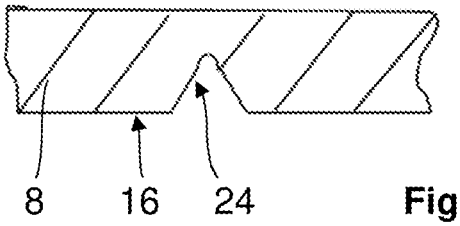
FIG. 2 shows the connecting plate of the exemplary embodiment in a partial cut-away plan view in the region of the material weakness.

As can be seen from an overall view of FIGS. 1 and 2, the connecting plate 8 includes a material weakening 24, wherein the material weakening 24 is disposed extending essentially transverse to the flow path 10 in the connecting plate 8, and wherein the material weakening 24 extends essentially from one free end to a free end of the connecting plate 8 opposite this free end, namely in the image plane of FIG. 1, from above to below. Here the material weakening 24 is configured as a V-shaped free punch in the connecting plate 8. In this regard see FIG. 2.

In the operating state of the heat-exchange device 2, it is disposed in a manner known to the person skilled in the art in a (not-depicted) base module of the laundry treatment machine. Here the base module comprises at least one (not-depicted) housing part and the heat-exchange device 2, accommodated in its operating state in the housing part, including the first heat exchanger 4 and the second heat exchanger 6, wherein in the operating state of the heat-exchange device 2, the two heat exchangers 4, 6 are disposed in the above-mentioned housing successively along the flow path 10 of the process air according to FIGS. 4*a* and 4*b*, and are connected to each other by the connecting plate 8, wherein the housing part can be configured as a base part, a cover part or an insert part of the base module.

Using the base module, namely using its above-mentioned housing part, alternatively or in addition to the side-plate connector 18, in the operating state of the heat-exchange device shown in FIGS. 4*a*, and 4*b* it is possible to fix the relative position in this operating state of the first heat exchanger 4 and of the second heat exchanger 6 with respect to each other.

The function of the inventive heat-exchange device and of the inventive base module according to the present exemplary embodiment are explained in greater detail below with reference to FIGS. 1 to 4*b*.

Initially the heat-exchange device 2 is present in its pre-installation state shown in FIG. 1. For example, in this pre-installation state the heat-exchange device 2 is supplied to the manufacturer of the laundry treatment machine by a supplier for the purpose of manufacturing the laundry treatment machine equipped therewith. As can be seen from FIG. 1, in its pre-installation state the heat-exchange device 2 has a very compact and thus advantageous design for storage and transport. Due to the rigidity of the heat-exchange device 2, which is achieved in particular by the rigidity of the connecting plate 8, in its pre-installation state the heat-exchange device 2 can be handled in a manner similar to a rigid construction unit.

Since the heat-exchange device 2 includes a soldering side 16 disposed on the connecting-plate-side for the purpose of automatic soldering, the manufacture of the heat-exchange device 2, namely the manufacture from its pre-installation state, is significantly simplified by the supplier. Accordingly the heat-exchange device 2 and thus the laundry treatment machine thus equipped is more economical.

Figure 3:
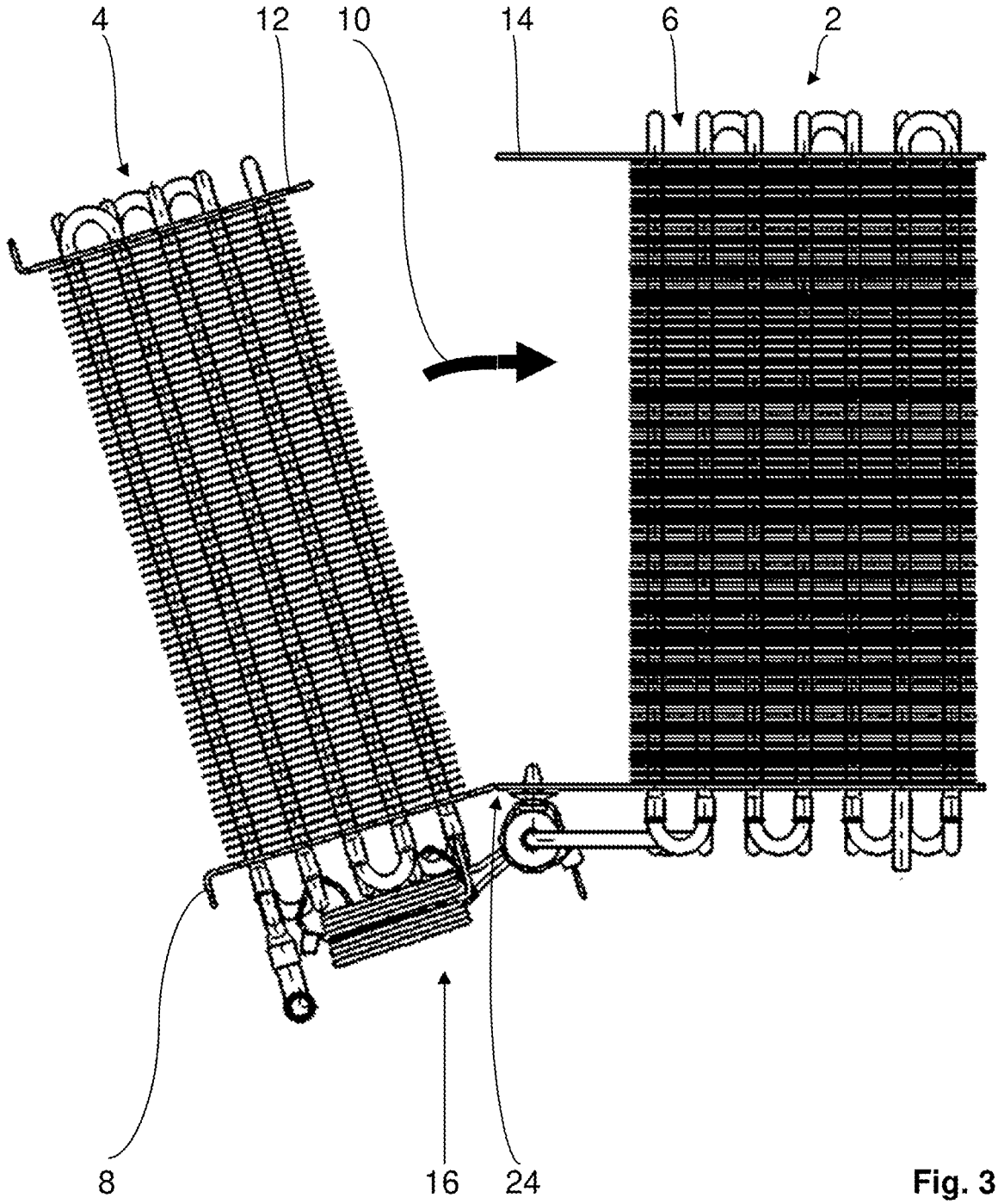
FIG. 3 shows the exemplary embodiment in a plan view, including the heat-exchange device during its transition into its operating state.

For the purpose of transitioning the heat-exchange device 2 from its pre-installation state according to FIG. 1 into its operating state according to FIGS. 4*a* and 4*b*, the connecting plate is bent by hand, i.e., purely manually, at its material weakening 24, configured as a bend point, into the shape depicted from FIGS. 3, 4*a* and 4*b*. The side plates 12, 14 that have been bluntly adjacent to each other up to now are accordingly removed from each other. For this purpose see in particular FIG. 3. The two heat exchangers 4, 6 of the heat-exchange device 2 are thus disposed angled with respect to each other, so that in the operating state shown in FIGS. 4*a* and 4*b* of the heat-exchange device 2, a favorable flow path 10 of the process air results. With suitable material selection of the connecting plate 8 and of a corresponding bending device, a transitioning of the heat-exchange device 2 into the operating state is alternatively also possible without material weakening.

To produce the above-mentioned operating state of the heat-exchange device 2, the two side plates 12, 14 are connected to each other in a force-transmitting manner by the side plate connector 18. For this purpose the latch hooks 22 formed on the side plate connector 18 are pressed into the latch openings 20 of the two side plates 12, 14, in a manner known to the person skilled in the art, until the latch hooks 22 are latched with the respective corresponding latch openings 20 in a force-transmitting manner. For this purpose see in particular FIGS. 4*a* and 4*b*.

Subsequently the heat-exchange device 2 according to FIGS. 4*a* and 4*b* is disposed in the (not depicted) base module in a manner known to the person skilled in the art, for example, in a housing part of the base module, which housing part is formed as a base part. Using the base module, namely by means of its above-mentioned housing part, in addition to the side-plate connector 18, in the operating state of the heat exchanger 2 shown in FIGS. 4*a* and 4*b* it is possible to fix the relative position in this operating state of the first heat exchanger 4 and of the second heat exchanger 6 with respect to each other. For example, in the operating state of the heat-exchange device 2, the above-mentioned fixing of the two heat exchangers 4, 6 can consist in that the two heat exchangers 4, 6 engage in an interlocking manner, with the connecting plate 8 on the one side, and the respective corresponding side plate 12, 14 on the other side, in corresponding grooves of the housing part of the base module, namely of the above-mentioned base part.

Due to the inventive design of the heat-exchange device according to the present exemplary embodiment, the storage and logistics, as well as manufacture of the heat-exchange device 2, and thus of the laundry treatment machine equipped therewith, is significantly simplified, without having to omit an angled flow path 10 of the process air through the heat-exchange device 2, namely through the two heat exchangers 4, 6 of the heat-exchange device 2. This angled flow path 10 of the process air flowing through the heat-exchange device 2 in its operating state is expedient and usual in laundry treatment machines for reasons of installation space and with regard to flow technology. However, in comparison to a heat-exchange device without angled flow path, this embodiment of the heat-exchange device usually has the disadvantage that such heat-exchange devices have greater space requirements during their storing and transport. Furthermore, manufacture of this type of heat-exchange device is usually more complex and thus more expensive. Here the invention provides a remedy in the manner described above.

However, the invention is not limited to the present exemplary embodiment. The inventive laundry treatment machine can also be configured as an industrial device, i.e., a device for professional use. The inventive laundry treatment machine can also be a washer-dryer, i.e., a combination device comprising a washing machine and a laundry dryer. An insert component of the base module can be configured, for example, as a sealed unit, in order to effectively avoid, or at least reduce, an undesired bypass flow of the process air in edge regions of the two heat exchangers of the inventive heat-exchange device.

In particular, the invention is not limited to the constructive and manufacturing-technology embodiments of the explained exemplary embodiment. For example, other embodiments of the invention are conceivable, wherein the two side plates are also present separately from each other in the operating state of the inventive heat-exchange device. Accordingly, in these cases the two side plates would not be connected to each other in a force-transmitting manner by a side-plate connector. For this purpose the relative position of the two heat exchangers of such heat-exchange devices to each other in their operating state could alternatively be fixable in the operating state merely by the at least one housing part of the base module, for example, the base part, the cover part, or the insert part of the base module.

In principle, however, embodiments of the inventive heat-exchange device are also possible, such that in the operating state of the heat-exchange device a first section of the flow path through the first heat exchanger and a second section of the flow path through the second heat exchanger are also disposed extending essentially in straight lengths with respect to each other. Accordingly, the two heat exchangers of this heat-exchange device would not be disposed angled with respect to each other.

What is claimed is:

1. A heat-exchange device (2) for a laundry treatment machine, comprising:

a first heat exchanger (4) and a second heat exchanger (6), wherein the first heat exchanger (4) includes a first side plate (12) and the second heat exchanger (6) includes a second side plate (14), the heat-exchange device having an operating state wherein the first and second heat exchangers (4,6) are disposed successively along a flow path (10) of process air of the heat-exchange device (2) and are connected to each other by a connecting plate (8), and wherein the first and the second side plates (12, 14) are connected together and each disposed on a side of the heat-exchange device (2) opposite the connecting plate (8), and the heat-exchange device having a pre-installation state wherein the first and the second side plates (12, 14) are disconnected.

2. The heat-exchange device (2) according to claim 1, wherein the connecting plate (8) is configured such that the connecting plate (8) stabilizes the heat-exchange device (2) at least in the pre-installation state such that the heat-exchange device (2) is configured to be handled as a pre-assembled construction unit.

3. The heat-exchange device (2) according to claim 1, wherein in the pre-installation state of the heat-exchange device (2), the two heat exchangers (4, 6) are disposed with respect to each other such that a first section of the flow path (10) through the first heat exchanger (4) and a second section of the flow path (10) through the second heat exchanger (6) are arranged as straight extensions of each other.

4. The heat-exchange device (2) according to claim 3, wherein in the operating state of the heat exchange device (2), the first heat exchanger (4) and the second heat exchanger (6) are disposed with respect to each other such that the first section of the flow path (10) and the second section of the flow path (10) enclose an angle greater than 0° and smaller than 180°.

5. The heat-exchange device (2) according to claim 4, wherein the angle enclosed by the first and second sections of the flow path (10) is an acute angle in the operating state.

6. The heat-exchange device (2) according to claim 1, wherein in the operating state of the heat-exchange device (2), the first side plate (12) and the second side plate (14) are configured to be connected to each other in a friction-fit manner using a side-plate connector (18), wherein the first and second side plates (12, 14) and the side-plate connector (18) include mutually corresponding connectors (20, 22).

7. The heat-exchange device (2) according to claim 1, wherein the connecting plate (8) includes at least one material weakening (24), wherein the material weakening (24) in the connecting plate (8) extends transverse to the flow path (10).

8. The heat-exchange device (2) according to claim 7, wherein the material weakening (24) extends from one free end to an opposite free end of the connecting plate (8).

9. The heat-exchange device (2) according to claim 1, wherein at least one of the first and the second heat exchangers (4, 6) is configured as a fin heat exchanger, comprising:

a plurality of fins disposed in parallel and spaced with respect to each other, for heat transmission between the heat exchanger (4, 6) and the process air, and at least one heat-exchange tube connected to the fins in a heat-conducting manner for guiding a heat-transmission.

10. The heat-exchange device (2) according to claim 9, wherein the heat-exchange device (2) includes a soldering side (16) for automatic soldering of the at least one heat-exchange tube.

11. The heat-exchange device (2) according to claim 10, wherein the soldering side (16) is disposed on a side of the heat-exchange device (2) facing the connecting plate.

12. A base module for a laundry treatment machine, comprising:

the heat-exchange device (2) according to claim 1, and at least one housing part, wherein the heat-exchange device (2) is accommodated in the housing part in the operating state, the first heat exchanger (4) and the second heat exchanger (6) being disposed successively in the at least one housing part, wherein the at least one housing part is configured as a base part, a cover part, or an insert part of the base module.

13. The base module according to claim 12, wherein in the operating state of the heat-exchange device (2), the at least one housing part is configured to fix a relative position between the first heat exchanger (4) and the second heat exchanger (6).

14. The heat-exchange device (2) according to claim 1, wherein, in the pre-installation state, the first and the second heat exchangers (4, 6) are connected to each other by the connecting plate (8).

* * * * *